US007118629B2

(12) United States Patent
Davidson

(10) Patent No.: US 7,118,629 B2
(45) Date of Patent: Oct. 10, 2006

(54) APPARATUS FOR APPLYING A COATING TO A ROOF OR OTHER SUBSTRATE

(76) Inventor: James W Davidson, 2595 Wadsworth Rd., Norton, OH (US) 44203

( * ) Notice: Subject to any disclaimer, the term of this patent is extended or adjusted under 35 U.S.C. 154(b) by 0 days.

(21) Appl. No.: 10/885,269

(22) Filed: Jul. 6, 2004

(65) Prior Publication Data

US 2006/0005765 A1 Jan. 12, 2006

(51) Int. Cl.
*B05B 3/12* (2006.01)
*B05B 3/18* (2006.01)

(52) U.S. Cl. ..... 118/323; 118/305; 239/750

(58) Field of Classification Search ..... 118/305, 118/323; 239/750–754, 227, 587.5
See application file for complete search history.

(56) References Cited

U.S. PATENT DOCUMENTS 3,040,381 A * 6/1962 Pioch ..... 425/162
3,266,729 A 8/1966 Baskett
3,379,377 A 4/1968 Ripple
3,383,046 A 5/1968 Veogtly
3,954,544 A 5/1976 Hooker
3,985,161 A 10/1976 Nelson
4,048,956 A 9/1977 Estebanez et al.
4,253,607 A * 3/1981 Gerard, Sr. ..... 239/750
4,402,459 A 9/1983 Berry
5,109,791 A 5/1992 Matsumoto et al.
5,670,178 A 9/1997 West
6,024,147 A 2/2000 Hunter, Jr.
6,036,123 A 3/2000 West
6,090,203 A 7/2000 Gebhardt et al.
6,358,344 B1 3/2002 Hunter, Jr.

* cited by examiner

*Primary Examiner*—Chris Fiorilla
*Assistant Examiner*—Yewebdar Tadesse
(74) *Attorney, Agent, or Firm*—Hudak, Shunk & Farine Co. LPA

(57) ABSTRACT

A device adapted to dispense or spray a coating such as a foam in a predetermined pattern or manner on a substrate, preferably a roof. The spray coating apparatus comprises a spray assembly having a carriage which is operatively mounted on a track that preferably provides a linear travel path. The carriage is controlled by a drive mechanism which causes reciprocating movement of the carriage. A spray gun is mounted on a holder of the carriage and controlled by an actuator and is used to uniformly apply coatings at a predetermined thickness controlled in part by a spray rate on the intended substrate. In one embodiment, the apparatus includes a cart which is either motorized or manual. The apparatus is lightweight and easily disassembled into sections in order to transport the device from a ground surface to a roof.

19 Claims, 6 Drawing Sheets

APPARATUS FOR APPLYING A COATING TO A ROOF OR OTHER SUBSTRATE

FIELD OF THE INVENTION

The present invention relates to a device adapted to dispense or spray one or more coatings such as a foam, powder, or liquid in a predetermined pattern or manner on a substrate, preferably a roof. The spraying apparatus comprises a spray assembly having a carriage which is operatively mounted on a track that preferably provides a linear travel path. The carriage is controlled by a drive mechanism which causes reciprocating movement of the carriage with substantially seamless reversal of direction. A spray gun is mounted on a holder of the carriage and controlled by an actuator to uniformly apply coatings at a predetermined thickness controlled in part by a spray rate on the intended substrate. In one embodiment, the apparatus includes a cart which is either motorized or manual in order to apply a coating to a stationary substrate such as a roof, wall, or the like. The apparatus is lightweight and easily disassembled into sections in order to transport the device from a ground surface to a roof, if desired.

BACKGROUND OF THE INVENTION

Numerous devices have been described for use in spraying various substrates from simple spray cans to robotically controlled articulating mechanisms. In the roofing industry, flat or low pitch roofs are often coated with one or more layers of coating such as polyurethane, silicone, or acrylic resin in order to provide insulating, UV, or waterproof barrier. Although many different types of spray applicators are available, with the known devices it is difficult to maintain uniform film thickness especially when applying a composition which expands or foams during application.

U.S. Pat. No. 3,379,377 relates to a spraying apparatus for automatically applying a coating of fluent material to an article of manufacture wherein a trolley mounted on an elevated support rail carries a sprayhead which is operable to spray an underlying article of manufacture during reciprocal movement of the trolley and it sprayhead along the support rail.

U.S. Pat. No. 3,383,046 relates to an apparatus for spraying a coating on a substrate, and more particularly to apparatus for spraying a coating of controlled irregular thickness.

U.S. Pat. No. 3,954,544 relates to an apparatus for in situ preparing and applying foam to a surface, such as a roof, and at the same time applying a membrane onto the surface of the foam, produces a foam-membrane sandwich held to the treated surface.

U.S. Pat. No. 5,670,178 relates to foamed plastic applied on a roof substrate by progressively dispensing expandable plastic foam material on the substrate along a path and progressively confining the vertical and lateral expansion of the material along the path and relative to the substrate. Apparatus for applying the foamed plastic comprises a platform having opposite ends and opposite sides having an endless belt supported on the platform for displacement relative thereto in the direction between the opposite ends. The belt is supported above the roof substrate by laterally spaced rails or by tracks on the belt, and a motor is provided on the platform for driving the belt to move the platform along the path. A dispensing gun is supported on the front end of the platform for dispensing expandable plastic foam material onto the substrate ahead of the belt and vertical and lateral expansion of the material is reportedly confined by the belt and rails or tracks as the platform moves along the path.

U.S. Pat. No. 6,036,123 relates to an apparatus for applying foamed plastic material on a roof deck which comprises a wheeled frame moveable along the deck and carrying a foamed plastic dispenser support and drive assembly which extends transverse to the direction of movement of the frame and which includes a carriage reciprocal in opposite directions along a linear carriage path and supporting a foamed plastic dispenser for reciprocation therewith and for pivotal displacement relative thereto at each of the opposite ends of the carriage path about a horizontal axis transverse to the carriage path so as to pivot the dispenser for discharging the foamed plastic material laterally outwardly of the ends of the support and drive assembly.

U.S. Pat. No. 6,358,344 relates to a method and an industrial robotic device for uniformly applying coatings upon a surface moves a spray applicator foam dispenser between two parallel tracks. The application of foam at each pass is performed by accelerating the speed of the foam dispenser at the end of each pass, by providing respective curved uphill distal ends of the tracks, so that the spray applicator foam dispenser moves up the curved distal ends and returns quickly while changing speed, tilt, and direction at the end of each pass.

The prior art devices suffer from numerous drawbacks. Prior art devices having limit switches at distal ends of a rail with a carriage moving therebetween often provide coatings which are relatively thicker at each end than in the middle due to the dwelling of the carriage at the end points during direction reversal. Spraying devices having an arced rail often are prone to overspray and/or flared out material at the ends of the spray path. Accordingly, some prior art devices are not suitable to allow for close proximity spray applications wherein the flare of a coating material would be cast on to an object that is not intended to be covered by the coating.

SUMMARY OF THE INVENTION

An apparatus for applying a coating to a substrate is described. The apparatus comprises a wheeled frame or cart adapted to be moveable along a surface or substrate. The cart can be moved manually or be equipped with a controllable drive means such as a motor or engine. A moveable spray assembly is operatively connected to the frame of the apparatus. The apparatus is constructed so that the sprayhead of the assembly generally reciprocates in a back and forth motion along a defined travel path without substantially stopping at the ends of the travel path.

The spray assembly includes a drive motor which is operable at various speeds controllable by an operator. The drive motor operates an endless drive mechanism which controls movement of a carriage adapted to accommodate a spray gun or other sprayhead operatively connected thereto. The carriage rides in a track formed by at least one rail. The carriage is operatively connected to the drive mechanism by a drive rod which provides for a substantially seamless change of direction of the carriage and allows for precise application of coating.

In one embodiment, the endless drive mechanism comprises a continuous chain or belt which travels around spaced axles, preferably having sprockets when a chain is utilized. Connected to one segment of the chain is a block and a rod rotatably connected to the rod. The rod is operatively and rotatably connected to the rear of the carriage for driving the same. In one preferred embodiment, an offset rod having offset ends is utilized to provide rapid change of direction of the carriage. The drive mechanism is preferably located in a housing to protect the moving parts. In a preferred embodiment, the carriage is operatively connected to the outside front of the housing and is moved in a substantially horizontal direction. In one embodiment, the carriage comprises slides or wheels which ride or travel in upper and lower rails.

The spray gun or device holder is connected to the carriage and adapted to accept any typical spray gun or device commonly utilized in applying foam or other coatings on a roof or other low slope surface. The spray gun holder includes an electromechanical lever adapted to activate the trigger switch of the spray gun or other spray device. The lever is height adjustable to a plurality of positions in order to accommodate substantially all of common commercially available spray guns. In one embodiment, the spray gun holder includes suitable structure which is adjustable to a plurality of positions and able to hold a spray gun or device at a predetermined angle with respect to a substrate or a portion of the apparatus.

It is therefore an object of the present invention to provide an apparatus and method capable of applying one or more coatings across a width and length of a substrate in an efficient, economic and reproducible manner.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
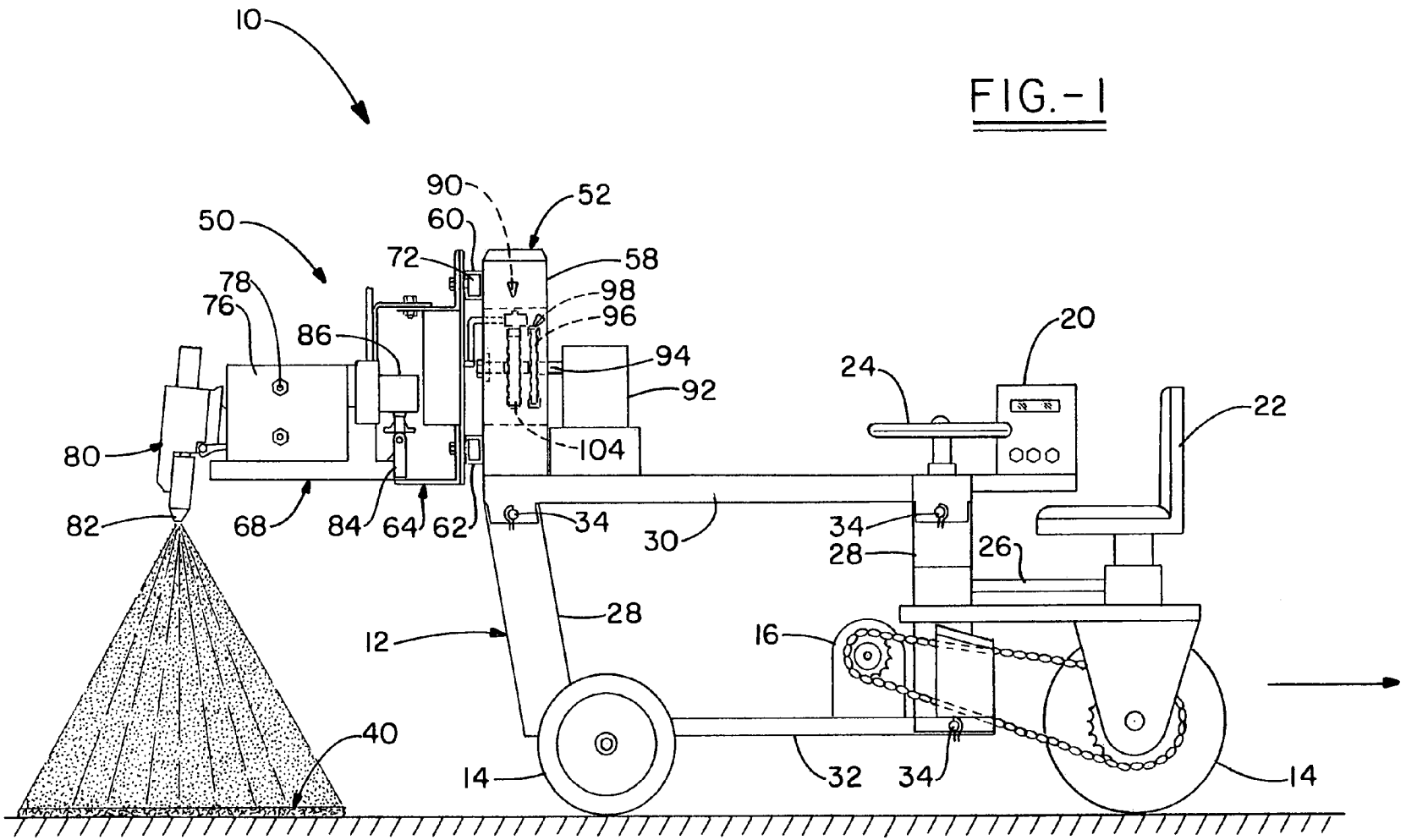
FIG. 1 is a side elevational view of an apparatus for applying a coating on a substrate in accordance with the present invention.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 7:
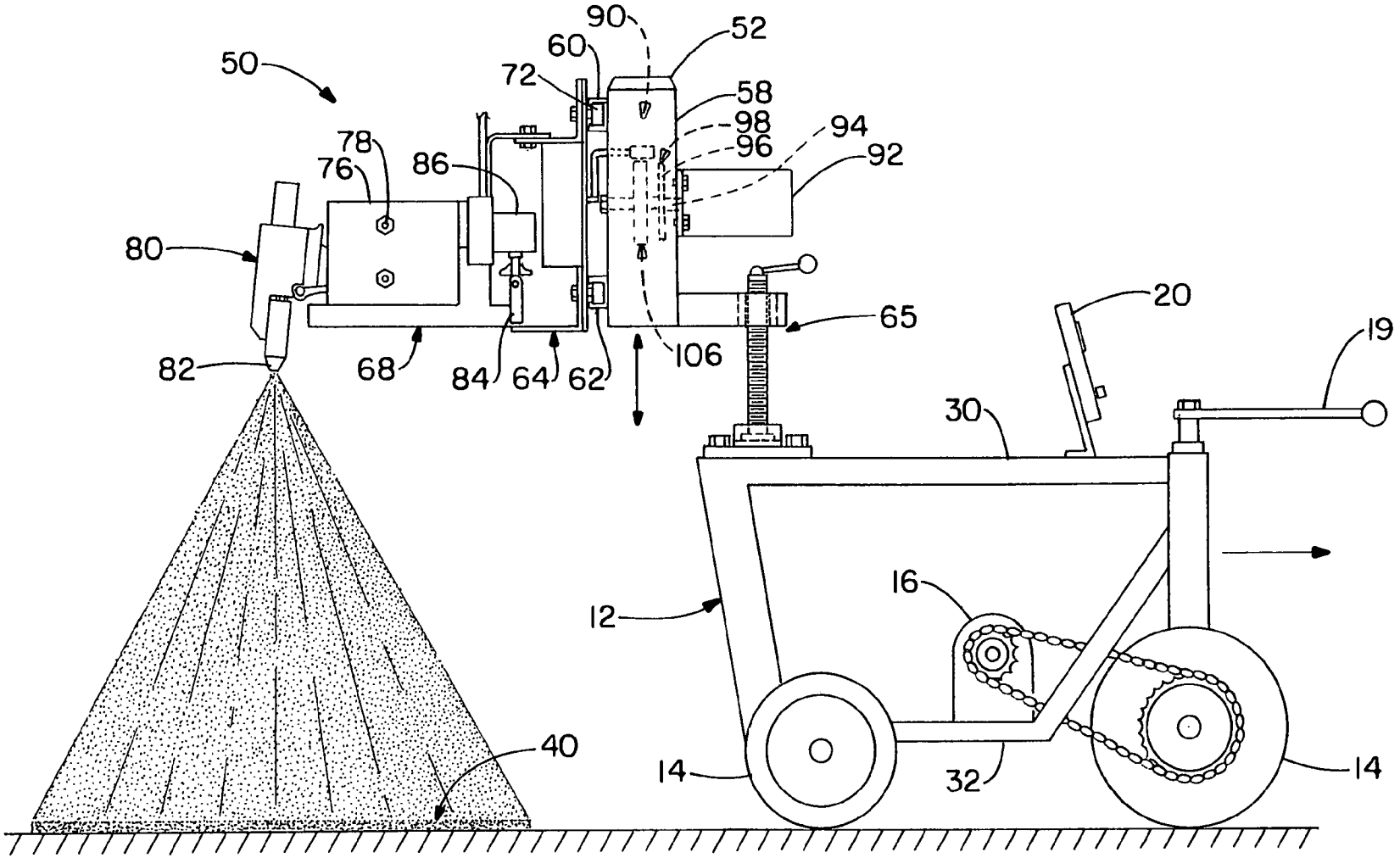
FIG. 7 is a side elevational view of a further embodiment of a walk behind coating apparatus.

Referring now to the drawings, FIG. 1 illustrates a mobile coating apparatus 10 particularly adapted for spraying one or more coatings, preferably polymeric coatings such as, but not limited to, expanding polyurethane foam of either one or two components, silicone or acrylic resin in predetermined amounts or thicknesses on a substrate such as a roof of a building. The spray coating apparatus 10 includes a frame 12 which supports a continuous drive spray assembly 50. While a box frame is illustrated in FIG. 1, it is to be understood that numerous other frame configurations could alternatively be employed such as an elongated frame, a triangular frame, a circular or rounded frame, or the like. FIG. 7 illustrates an apparatus designed to be utilized by an operator who can walk behind and control the functions thereof.

The frame 12 in one embodiment has a primary purpose of providing mobility to the spray assembly 50 in order to coat immovable or stationary objects. That said, the frame is provided with wheels 14 which can be drive wheels or driven wheels. The frame is moveable manually using handles or with power source 16 such as an electric drive motor which is operatively connected via a suitable linkage, such as a chain, belt, axle, spindle, or the like to at least one drive wheel 14 or axle thereof as shown in FIG. 1. In one embodiment, the frame 12 is equipped with an operator seat 22 and steering controls 24 which through suitable linkage 26 allow one or more wheels to be turned or manipulated and thus control the direction of movement of the frame 12 and spray assembly 50 thereon. In one embodiment, if the frame 12 is to be moved manually and no steering controls are present, at least one wheel 14 utilized is a caster wheel in order to provide steering or direction change to the frame. FIG. 7 illustrates a walk behind coating apparatus 10 including a manual steering arm 19 which controls turning movement of wheel 14. The spray assembly 50 is height or vertically adjustable in relation to cart frame 12 and also the ground surface.

Frame components such as posts or uprights 28 and upper and lower rails 30 and 32 respectively are connected by welding or other suitable fastening means well known to those of ordinary skill in the art in a desired configuration. As stated herein, one preferred use of the device is in coating a roof of a building. Accordingly, in one embodiment, the coating apparatus is provided with one or more fittings 34 which allow disassembly of the frame into two or more pieces which are individually transportable and more easily raised or lowered from a roof surface to a ground surface, or moved from location to location. The fittings 34 in some embodiments can include one or more of, but are not limited to, pinned couplings, mating tubes or other elements, fixable attachment elements such as screws and bolts, pull pins, clips, threaded fittings or sleeves. The frame is constructed from any durable material such as wood, metal, or polymeric material, with metal highly preferred. Metal tubing, bar stock such as square or angle bar are utilized in some embodiments.

The frame 12 supports one or more operator control panels 20 adapted to be connected to a suitable source of electric power by a cord or other mechanism. The control panel can also be used to house non-electrically or semi-electrically powered devices such as cable controlled devices, or air or hydraulic activated devices, etc. The control panel is preferably connected to the frame at a location where the operator can conveniently perform desired adjustment of the apparatus. The apparatus 10 control panel 20 preferably comprises a device for control of the speed of the spray assembly 50, a device for control of amount of coating dispensed per unit of time, or a device for control of the ground speed of the apparatus 10, or a spray gun trigger activating device controller or combinations thereof. The control devices can be switches, rheostats, or the like as known to those of ordinary skill in the art. In one embodiment, the control panel includes a central processing unit adapted to control one or more functions of the spray coating apparatus 10. One suitable unit is commercially available from Eaton Corporation of Moon Township, Pa. as a Cutler-Hammer MVX9000 Adjustable Frequency Drive. In a preferred embodiment, the control panel is configured or programmed in order to control all desired functions of the continuous drive spray apparatus 50, the coating cart frame movement, and the spray gun activating device 84 simultaneously.

As will become apparent, in operation, the operator controls the movement of the apparatus 10 along substrate 40 as well as application of coating from continuous drive spray assembly 50. In operation, generally the apparatus is moved forward in the direction from the rear of the frame towards the spray assembly 50 following a path controlled by the position of the wheels with the coating dispensed downwardly from the spray gun or device 80.

As illustrated in FIG. 1, the spray assembly 50 is operatively connected to a front portion of frame 12, such as rail 30 through suitable attachment elements, such as welding or removable fastening elements. In an alternative embodiment as shown in FIG. 7, the spray assembly is operatively connected to the frame 12 through a height adjustable jack 65.

The spray assembly 50 is connected to the apparatus 10 so that the bottom end of the housing 52 or the coating outlet nozzle 82 of a spray gun 80 or other device adapted to be attached to the assembly is located at a vertical distance generally from about 6 to about 60 inches, desirably from about 12 to about 48 inches, and preferably from about 24 to about 36 inches from a ground surface or a generally horizontal plane extending from the bottom of wheels 14. Of course, it is to be understood that the height of the nozzle of the spray gun 80 or bottom end of housing 52 may vary outside of the stated parameters depending on the coating to be applied or various characteristics of the substrate. A front elevational view of the spray assembly 50 is shown in FIG. 2.

Spray assembly 50 includes housing 52 which operatively connects the assembly to frame 12. Housing 52 is generally elongated or rectangular having first and second ends 54, 56, which are preferably curved in one embodiment. Guide rail members 60, 62 are connected to the front of housing 52, preferably by welding. Each rail has an upper or lower groove or channel; or a combination thereof which preferably extends the length of the rail. The groove is "C" or "V" shaped in some embodiments. The rail members substantially co-extend, preferably substantially horizontally along the length of housing 52 between ends 54, 56 having a length of generally of from about 24 to about 120, desirably from about 48 to about 96 and preferably from about 48 to about 72 inches, with about 60 inches most preferred.

Figure 2:
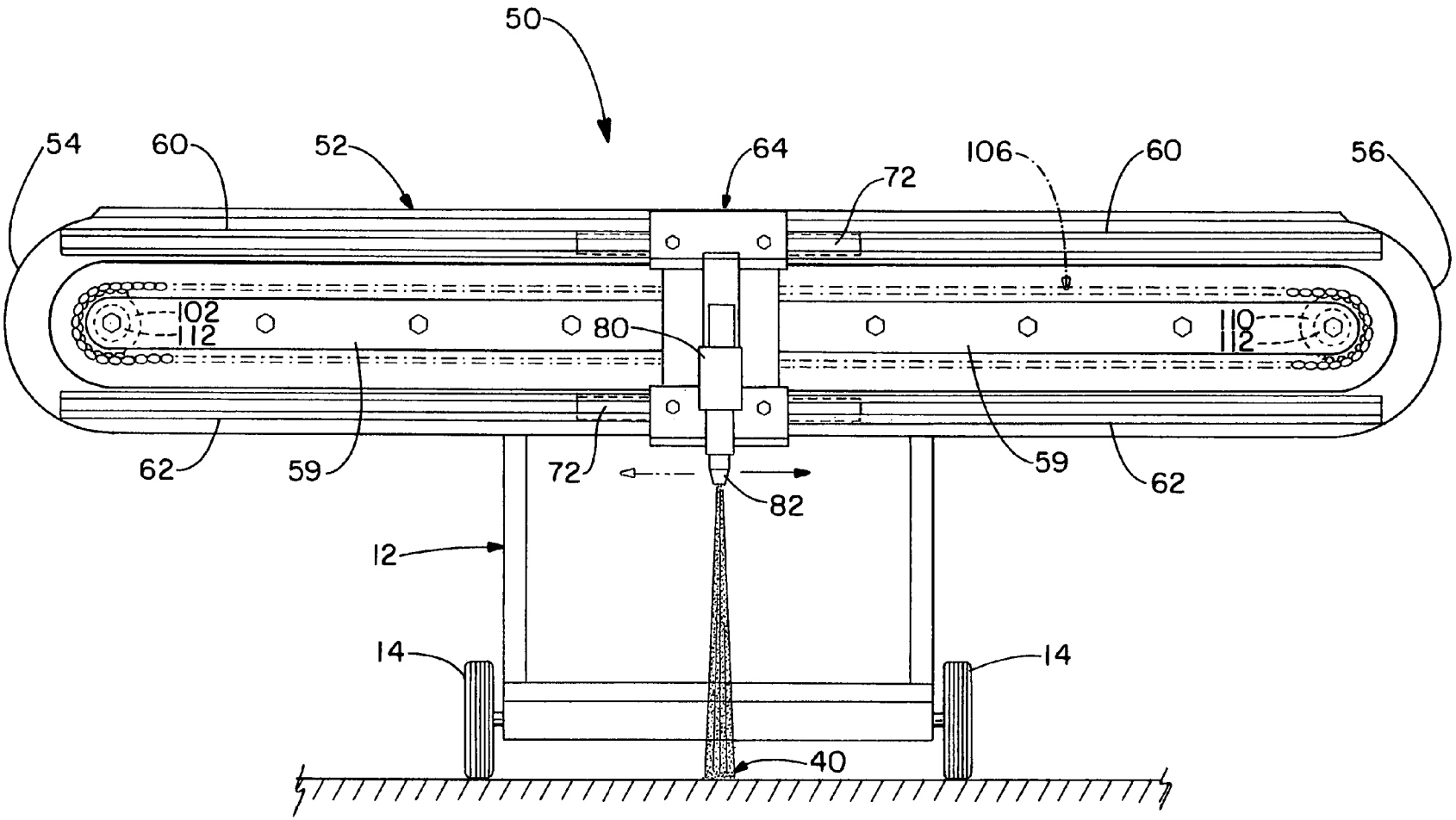
FIG. 2 is a front elevational view of the apparatus assembly for spray applying a coating on a substrate shown in FIG. 1.
Figure 4:
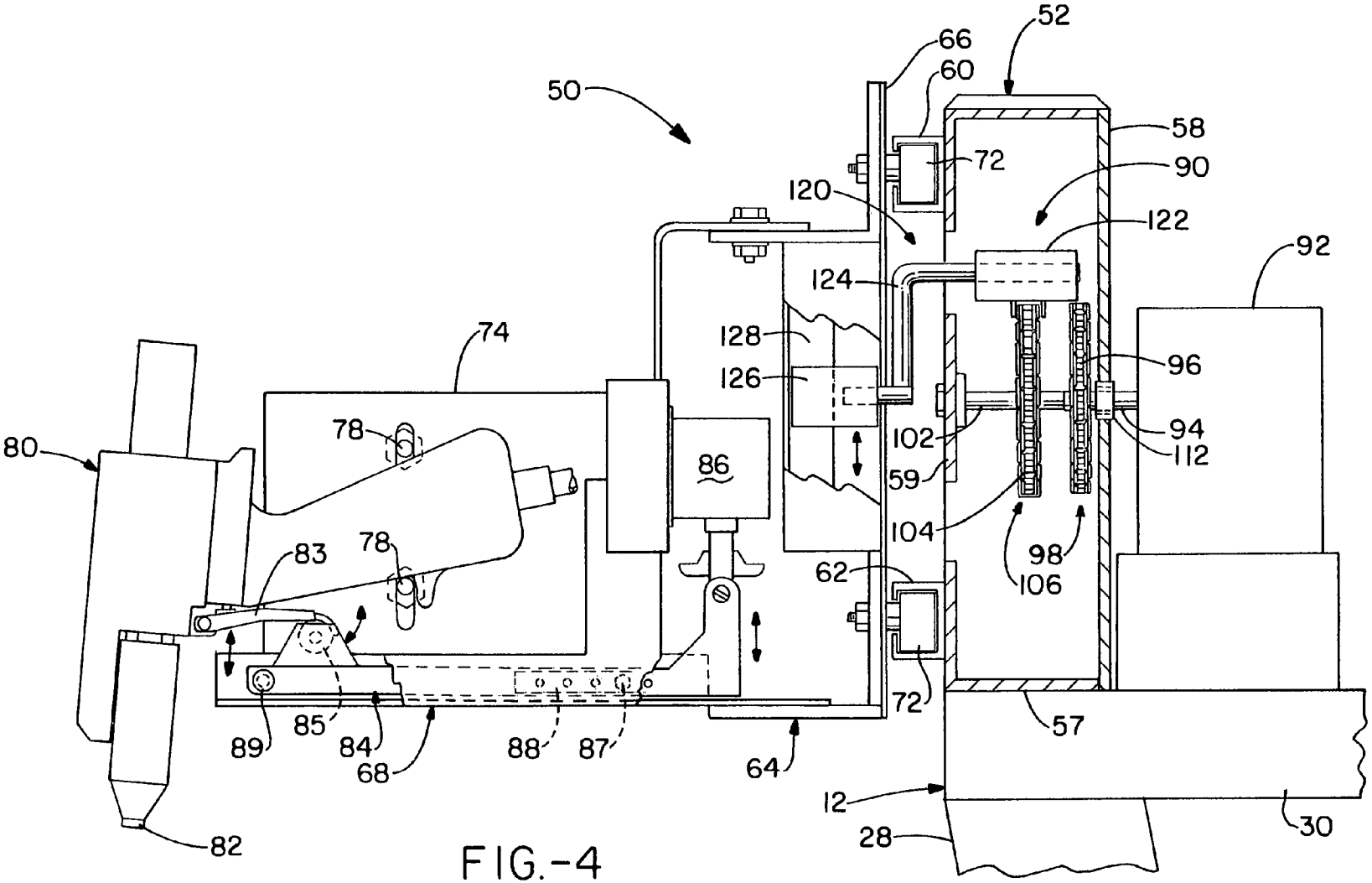
FIG. 4 is an enlarged side elevational view, with portions broken away, of the continuous drive spray apparatus forming a primary portion of the coating apparatus shown in FIGS. 1–3.

As shown in FIGS. 2 and 4, carriage 64 is operatively connected in at least one rail member 60 or 62 for lateral movement back and forth between the ends of rails 60, 62. Carriage 64 includes a back plate 66 which is operatively connected to spray assembly drive mechanism 90. One or more guide members 72 such as wheels, bearings, or other low friction slide elements such as Teflon®, Viton®, an ultra high molecular weight polymer, or other polymer, or wood, metal, carbon fiber, etc. are operatively connected in guide rails 60, 62 with the upper and/or lower portions thereof disposed in alignment with at least a portion of the groove or channel of the guide rail members present and travel therein when the carriage 64 is manipulated by the drive mechanism 90.

Carriage 64 further includes a spray device support assembly or arm 68 which is operatively attached to the carriage back plate 66, as shown in FIG. 4. The spray device support assembly 68 is adapted to hold and maintain a spray gun or device 80, and preferably nozzle 82 in a predetermined position or angle with respect to horizontal or the surface of a substrate to be coated. In one embodiment, the spray device support assembly 68 includes two holding members 74, 76 each preferably having a compressible or deformable face, preferably rubber, or an elastomer, etc., which contact a surface of the coating or spray device 80 such as a grip portion as shown in FIG. 4. Members 74, 76 are movable in relation to each other and/or other portions of the apparatus 10 and can be fixed by a clamp or other fastener in order to firmly hold the spray device 80 in the noted predetermined position. In one embodiment, the assembly includes one or more adjustment elements 78 positionable at various locations on either of the holding members 74, 76 to aid in placement of a particular spray device desired to be utilized. Accordingly, the spray device support assembly 68 is adapted to accept substantially any commercially available spray device without substantial and preferably any modification.

The spray device support assembly 68 in one embodiment includes a trigger activating device 84 which is adapted to activate a trigger on the spray device 80. As shown in FIG. 4, trigger activating device 84 includes a trigger contacting element 85 adjustably connected to adjustable length guide 88. The trigger contacting element 85 can be adjustably raised or lowered vertically in order to provide a predetermined contact point, to better fit a particular trigger such as by changing vertical length of an actuator bar of solenoid 86 or height of element 85 on device 84. Adjustable length guide 88 comprises mateable or connectable slides or members which can be fixed at a plurality of different lengths through one or more apertures present on each member and a fixing element 87 such as a threaded pin. One end of adjustable length guide 88 is connected to solenoid 86 or other mechanism which is operated by a control connected thereto, such as at control panel 20 through suitable linkage. The front end portion of adjustable length guide 88 is pivotally connected to spray device support arm assembly 68. The trigger contacting element 85 can be moved to a plurality of positions along guide 88 in order to accommodate different spray device 80 trigger styles. When solenoid 86 is activated or deactivated, the adjustable length guide 88 is pivoted about pivot point 89 thus raising or lowering spray gun trigger 83 through trigger contacting element 85 in order to start or stop a flow of coating therefrom. The length and height of adjustable guide 88 as well as the length of stroke of activating solenoid 86 can be adjusted in order to accommodate and thus activate a trigger 83 of spray gun 80 to account for variables that exist between commercially available spray guns.

Figure 3:
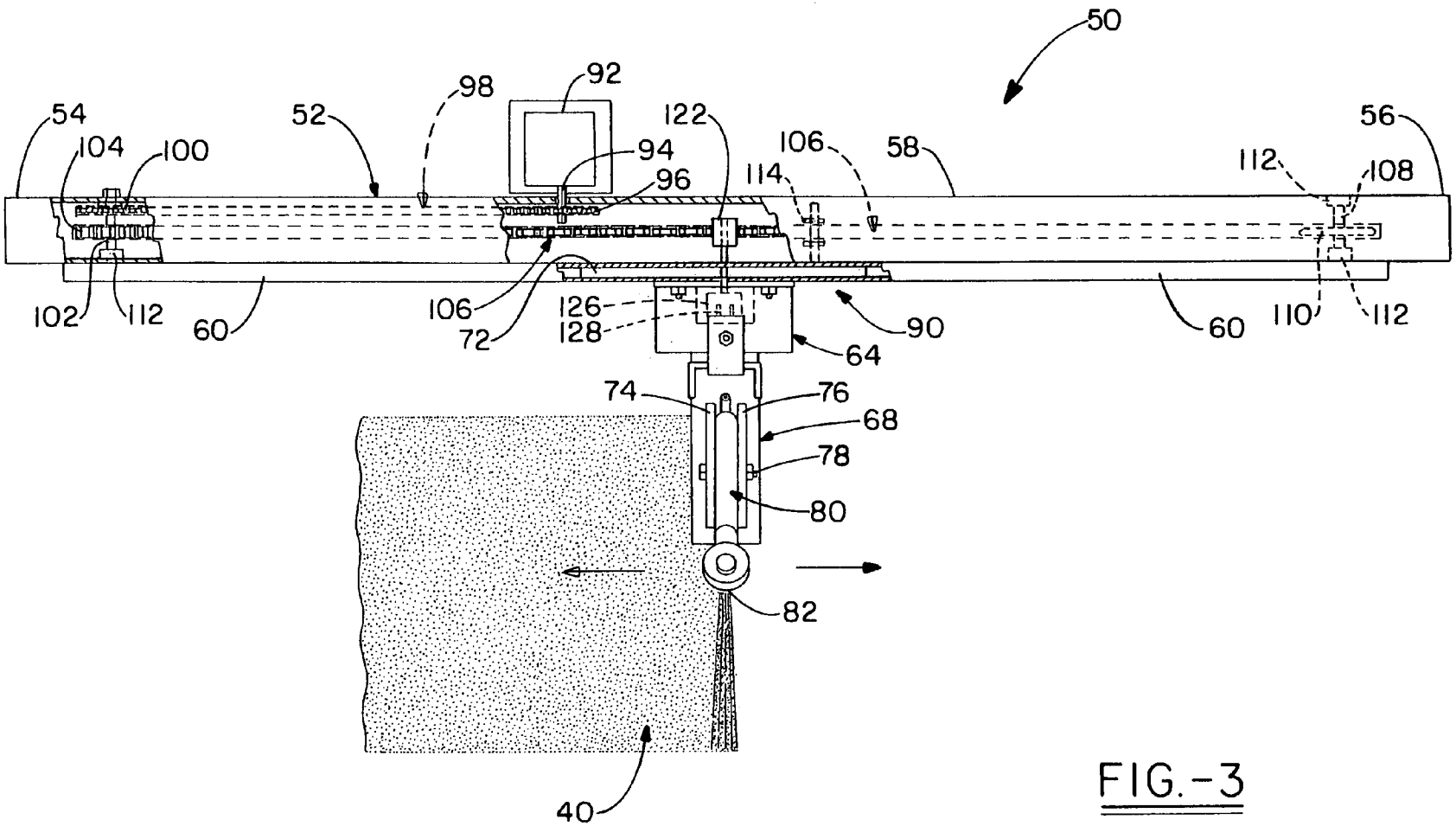
FIG. 3 is a top view of the apparatus shown in FIGS. 1 & 2 with portions broken away to better illustrate various elements of the apparatus.

In a further embodiment, the spray device support arm assembly 68 is positionable in relation to other portions of the carriage in the continuous drive spray assembly. As illustrated in FIG. 4, the spray device support arm assembly 68 is adjustably connected to carriage 64 utilizing one or more fasteners, such as the upper bolt shown. When the bolt(s) or other fastener(s) are loosened, the spray device support arm assembly 68, as illustrated in FIG. 3, can be pivoted to the left or right in order to achieve a desired angled spraying position. The typical or normal position of the spray device shown in FIG. 3 has an angle of about 90° with respect to the longitudinal direction of the continuous spray mechanism 90. Alternatively, the spray device support arm assembly can be moved in a range generally from about 45° to about 135°, i.e., about 45° from either side of the centered 90° position. When at a desired position, fastener(s) can be tightened and spray coating apparatus 10 operated to coat a desired substrate.

Turning now to the continuous drive mechanism 90 of the drive spray assembly 50, the mechanism 90 is shown in FIGS. 1–4 and 7 and is utilized to reciprocate the carriage 64 and spray device 80 connected thereto in order to apply a coating to an intended substrate in a predetermined pattern and thickness. Housing 52 includes a back plate 58 which is fixedly connected to the apparatus frame 12 directly or indirectly through another stationary portion of housing such as housing base 57 as shown in FIG. 4. Backplate 58 serves as a fixed foundation to which the continuous drive mechanism 90 is attached. Motor 92 is operatively connected to housing back plate 58 so that at least rotatable motor shaft 94 thereof extends into the housing 52. As illustrated in FIG. 4, the motor housing can be attached to frame 112. Sprocket 96 is connected to motor shaft 94 and is suitably constructed with teeth or the like in order to manipulate or rotate continuous drive chain or belt loop 98. Drive chain loop 98 is connected at a second end around sprocket 100 which is fixed to first axle 102 which is journaled and rotatable in bearings 112 attached to back plate 58 and floating plate 59. An additional sprocket 104 is also fixedly attached to first axle 102 and has one end of second drive chain loop 106 threaded therearound. Second rotatable axle 108 is spaced a predetermined distance from first axle 102 and is operatively connected to the other end of drive chain 106 via sprocket 110. Second axle 108 is rotatably connected to back plate 58 and front plate 59 via bearings 112. Alternatively, the axles can be fixed and the sprockets rotatable on the axle through bearings. In one embodiment, a chain guide is provided to maintain desired alignment of the endless chain 106 between sprockets 104, 110. The spacing between axles 102 and 108 is set such that the desired carriage travel distance and/or chain tension is achieved. In one embodiment, a chain tensioner is provided to maintain a predetermined chain tension. Accordingly, whenever motor 92 is activated, the endless chain 106 rotates around the sprocket on axles 102, 108 and has a generally oblong or oval path.

In order to reciprocally drive carriage 64 and associated spray device 80, the continuous drive mechanism 90 is operatively connected thereto through a carriage driving assembly 120, illustrated in at least FIG. 4. A chain follower or attachment member 122 is connected to one or more segments of the drive chain loop 106, preferably through a link thereof, and follows the path of the chain loop around axles 102, 108. As illustrated in FIG. 4, connection member such as rod 124 of the carriage driving assembly is pivotably and/or rotatably connected to chain attachment member 122. Second end of rod 124 is rotatably or pivotably connected in carriage drive block member 126. The rotatable or pivotable connections allow rod 124 to drive carriage 64 in a smooth manner and cause reciprocating movement thereof with substantially seamless reversal of direction at the ends of the drive path. The pivoting or rotating etc. motion allows the carriage to continue to move and fluidly change direction as the chain attachment member rotates around a sprocket at the end of the travel path. Carriage drive block member 126 is operatively connected to drive block mounting members 128. Carriage drive block member 126 is generally moveable in a vertical direction, i.e., up and down, along a track of mounting member 128 during operation in order to provide a desired fluid action to the continuous drive spray assembly 50 of the present invention. In a preferred embodiment, rod 124 has offset ends and thus the rod is "s" or "z" shaped. While the rod can be straight, in order to provide for substantially uninterrupted flow of the continuous drive chain in spray gun carriage 64, the rod 124 is preferably utilized having offset ends. The carriage drive assembly 120 pulls carriage 64 back and forth smoothly along its drive path.

The arrangement of structure in the present invention is such that when chain drive 106 is operatively driven around axles 102 and 108 by motor 92, the chain attachment member 122 connected to the chain drive 106 is moved along the travel path formed by the chain. Carriage 64 operatively attached to the carriage driving assembly 120 travels back and forth in rails 60 and 62. Once chain attachment member 122 reaches a sprocket 104, 110, the member continues along the chain path, rotates therearound, and reverses direction. As rod 124 is free to rotate or twist within both chain attachment member 122 and carriage drive block member 126, the change of direction of the carriage is almost seamless and there is not a substantial dwell time at the end of the carriage travel path. The carriage 64 and attached spray device 80 will traverse the apparatus back and forth according to the amount of power provided to the electric drive motor. The present invention is free of any limit switches, as the same are not needed in order to change direction of the carriage 64 and associated spray device support arm assembly 68 which is adapted to house spray device 80. Due to the configuration of the continuous drive assembly 50, the transition from one direction to another is almost seamless and not abrupt like the prior art devices. Accordingly, consistent coating thicknesses are achieved with the present invention spray coating apparatus.

In operation, a spray gun device 80 is attached to the apparatus between spray gun opposed holding members 74 and 76 which are generally plate shaped so that the nozzle 82 of the spray device is oriented at a predetermined angle with respect to the substrate to be coated. The spray device is secured via adjustment elements 78 so that trigger contacting element 85 or trigger activation device 84 can operate spray device 80 trigger 83. The continuous drive spray assembly 50 is actuated thus causing the carriage 64 to traverse back and forth on the apparatus in rail 60 and 62. The spray device is subsequently activated utilizing trigger activating device 84. After a predetermined amount of coating is applied by the reciprocating spray assembly, the coating apparatus is moved either manually or automatically utilizing the controls described herein in order to coat a subsequent area of the substrate.

The coating apparatus of the present invention is adapted to apply substantially any material which can be expelled from a coating or spray device including both one and two component materials. Examples of coating material include, but are not limited to, polyurethanes, silicones, acrylates, tars, oils, oil or latex based paints, solvents, powder coatings, mastics, liquids, or the like. The coatings can be applied to generally any thickness, and is dependent on speed of the carriage, coating flow rate through spray device, speed of apparatus along a ground surface, etc. Typically, the coating is applied to achieve a thickness of about 1 to about 100 or about 1000 mils. Of course, dry film thickness can be less or greater than the coating thickness depending on the compositions thereof. For example, when a foaming polyurethane is used, dry film thicknesses can range from 0.1 inch to about 6 inches, desirably about 0.25 to about 2 inches, with about 0.5 inch preferred.

Figure 5:
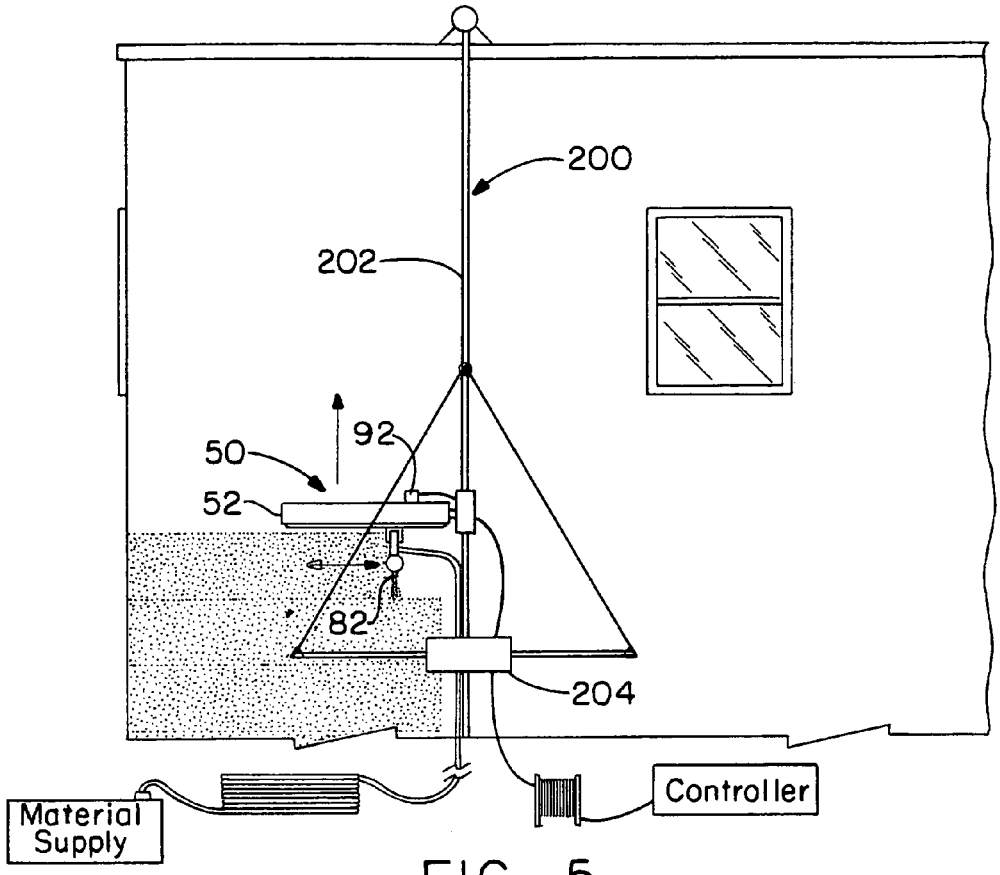
FIG. 5 illustrates the continuous drive spray assembly connected to a wall coating apparatus.

As illustrated in FIG. 5, the continuous drive spray assembly can be utilized in a wall coating apparatus 200 in order to coat surfaces which are substantially vertical or otherwise angled. Wall coating apparatus 200 includes a wall mount attachment 202 and a traversing section 204 which travels along wall mounting segment 202. Traversing section 204 can be attached to a chain or cable which can be moved along wall mounting segment 202. The traversing section 204 is situated at a desired height so that the spray assembly can operate and coat a predetermined area of a surface. The coating apparatus and portions thereof are detachable from the wall and moveable in relation thereto wherein the process can be repeated. In this manner, the continuous drive spray assembly can be utilized to provide a coating to a vertical or other angled surface.

Figure 6:
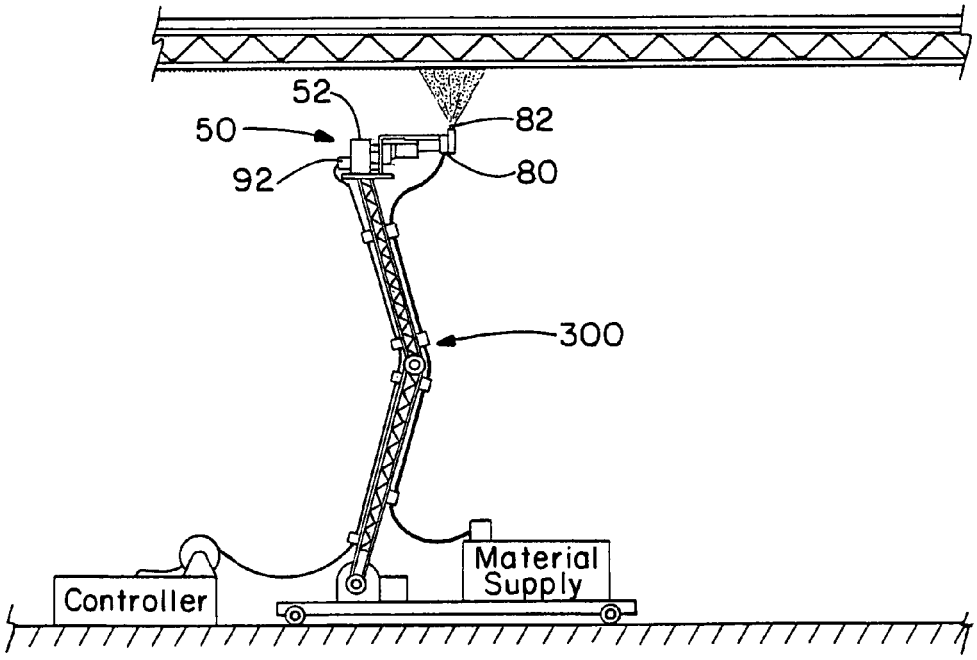
FIG. 6 illustrates the continuous drive spray assembly connected to an adjustable hoist.

Yet another embodiment of the present invention is illustrated in FIG. 6 wherein the continuous drive spray assembly is operatively mounted to adjustable hoist 300. As illustrated, the spray assembly 50 is being utilized to provide a coating to a ceiling. Adjustable hoist 300 is moveable in both vertical and/or horizontal directions in order to provide spray assembly 50 access to a substrate to be coated. Accordingly, the continuous spray drive assembly of the present invention has many alternative uses and adaptations.

In accordance with the patent statutes, the best mode and preferred embodiment have been set forth, the scope of the invention is not limited thereto, but rather by the scope of the attached claims.

What is claimed is:

1. A coating apparatus, comprising:

a frame adapted to be moved in relation to a substrate;

a spray assembly connected to the frame, the spray assembly having a carriage and a drive mechanism which reciprocates the carriage along a travel path, wherein the carriage includes a spray device support assembly adapted to hold a spray device capable of applying a coating on the substrate, wherein the carriage is operatively connected to the drive mechanism through a carriage driving assembly which provides a change of direction at ends of a travel path of the carriage, wherein the spray assembly is free of limit switches at ends of the travel path, wherein the carriage driving assembly includes a connecting member rotatably connected at a first end to a portion of the drive mechanism and rotatably connected at a second end to a portion of the carriage, wherein the drive mechanism includes a drive member which travels around axles spaced at a predetermined distance, and wherein the drive member has an attachment member connected thereto which is rotatably connected to the first end of the connecting member.

2. The coating apparatus according to claim 1, wherein the connecting member has offset ends.

3. The coating apparatus according to claim 2, wherein the spray assembly has a height which is adjustable in relation to the frame, wherein the carriage driving assembly includes a drive chain or belt.

4. The coating apparatus according to claim 1, wherein the carriage has a drive block member to which the second end of the attachment member is connected, and wherein the drive block member is movable in a substantially vertical direction.

5. The coating apparatus according to claim 1, wherein the frame includes at least one wheel, wherein the carriage includes a guide rail, and wherein the apparatus includes a controller which controls at least one of the following: ground speed of the apparatus, coating flow rate, spray device coating or flow, or carriage speed, or a combination thereof.

6. The coating apparatus according to claim 1, wherein the spray device support assembly further includes a spray device activating mechanism capable of controlling coating flow from a spray device, and wherein the activating mechanism includes a trigger activating member which is adjustable and adapted to manipulate a trigger of the spray device.

7. The coating apparatus according to claim 1, wherein the drive mechanism includes a drive motor which operatively moves the drive member along a drive path.

8. The coating apparatus according to claim 7, wherein the carriage has a drive block member to which the second end of the connecting member is connected, and wherein the drive block member is moveable in a substantially vertical direction.

9. The coating apparatus according to claim 8, wherein the drive member is a chain or belt which is operatively connected around spaced axles.

10. An apparatus for spray coating a surface, comprising:

a frame having one or more wheels, wherein the frame is adapted to be moved in relation to the surface;

a spray assembly operatively connected to the frame, wherein the spray assembly includes a carriage that moves back and forth along a travel path when activated by a drive mechanism of the spray assembly, wherein the carriage comprises a support assembly holding a spray device at a predetermined position adapted for applying a coating on the surface, wherein the carriage is operatively connected to the drive mechanism by a carriage driving assembly including a connecting member having a first end pivotally connected to a portion of the drive mechanism and a second end pivotally connected to a portion of the carriage wherein the connecting member first end is offset from the connecting member second end, wherein the drive mechanism includes a drive motor which moves a drive member along a drive path.

11. The apparatus according to claim 10, wherein the carriage has a drive block member to which the second end of the connecting member is connected, wherein the drive block member is moveable in a substantially vertical direction when the travel path is substantially horizontal, wherein the drive member is a chain or belt which is operatively connected around spaced axles, wherein the spray assembly is free of a limit switch at an end of the travel path, and wherein the travel path of the carriage is linear.

12. The apparatus according to claim 10, wherein the carriage has a drive block member to which the second end of the connecting member is connected, wherein the drive block member is moveable in a substantially vertical direction when the travel path is substantially horizontal, and wherein the drive member is a chain or belt which is operatively connected around spaced axles.

13. The apparatus according to claim 12, wherein the spray device support assembly further includes a spray gun activating mechanism capable of controlling coating flow from the spray gun, and wherein the activating mechanism includes a trigger activating member that selectively activates or deactivates a trigger of the spray gun to control a flow of coating therefrom.

14. An apparatus for applying a coating to a substrate, comprising:

a frame adapted to be moved in relation to the substrate; and a spray assembly connected to the frame, such that a coating outlet nozzle of a spray gun of the spray assembly is adapted to be located at a distance of about 6 to about 60 inches from the substrate, wherein the spray assembly comprises a carriage and a drive mechanism that reciprocates the carriage along a linear travel path, wherein the spray assembly is free of a limit switch at an end of the travel path, wherein the drive mechanism includes an attachment member connected to a belt or chain that travels around axles spaced at a predetermined distance when activated by a drive motor, and wherein the carriage is operatively connected to the attachment member by a rotatable connecting member that provides a change of direction at the ends of the travel path.

15. The apparatus according to claim 14, wherein the connecting member has offset ends.

16. The apparatus according to claim 14, wherein the connecting member has a first end rotatably connected to the attachment member and a second end rotatably connected to a portion of the carriage.

17. The apparatus according to claim 16, wherein the carriage has a drive block member to which the second end of the attachment member is connected, and wherein the drive block member is movable in a substantially vertical direction when the travel path is substantially horizontal.

18. The apparatus according to claim 17, wherein the frame includes at least one wheel, wherein the carriage includes a guide rail, and wherein the apparatus includes a controller which controls at least one of the following: ground speed of the apparatus, coating flow rate, spray device coating or flow, or carriage speed, or a combination thereof.

19. The apparatus according to claim 18, wherein the spray device support assembly further includes a spray device activating mechanism capable of controlling coating flow from a spray device, and wherein the activating mechanism includes a trigger activating member which is adjustable and adapted to manipulate a trigger of the spray device.

* * * * *